US009072642B2

(12) United States Patent
Miller

(10) Patent No.: US 9,072,642 B2
(45) Date of Patent: Jul. 7, 2015

(54) TREATMENT DEVICE

(76) Inventor: Cornelia Miller, Oberstdorf (DE)

( * ) Notice: Subject to any disclaimer, the term of this patent is extended or adjusted under 35 U.S.C. 154(b) by 0 days.

(21) Appl. No.: 14/238,051

(22) PCT Filed: Jul. 9, 2012

(86) PCT No.: PCT/EP2012/002891

§ 371 (c)(1),
(2), (4) Date: Mar. 25, 2014

(87) PCT Pub. No.: WO2013/020623

PCT Pub. Date: Feb. 14, 2013

(65) Prior Publication Data

US 2014/0289966 A1 Oct. 2, 2014

(30) Foreign Application Priority Data

Aug. 10, 2011 (DE) ..... 20 2011 104 239 U

(51) Int. Cl.

| | |
|---|---|
| ***A61G 5/12*** | (2006.01) |
| ***A61G 13/12*** | (2006.01) |
| ***A61G 15/12*** | (2006.01) |
| ***A61H 37/00*** | (2006.01) |
| *A61G 15/00* | (2006.01) |

(52) U.S. Cl.

CPC ..... *A61G 5/12* (2013.01); *A61G 15/002* (2013.01); *A61G 15/007* (2013.01); *A61G 15/12* (2013.01); *A61H 37/00* (2013.01); *A61G 13/12* (2013.01); *A61G 2005/121* (2013.01); *A61G 2005/128* (2013.01)

(58) Field of Classification Search

CPC ..... A61G 5/12; A61G 13/12
USPC ..... 5/621–622, 636–637, 640; 297/423.11, 297/423.14

See application file for complete search history.

(56) References Cited

U.S. PATENT DOCUMENTS

D304,614 S * 11/1989 Guttormsen ..... D24/183

FOREIGN PATENT DOCUMENTS

| | | |
|---|---|---|
| DE | 20 2006 017 422 | 5/2007 |
| DE | 20 2009 011 447 | 3/2010 |
| GB | 2 362 315 | 11/2011 |

OTHER PUBLICATIONS

Translation International Preliminary Report on Patentability.

* cited by examiner

*Primary Examiner* — Fredrick Conley
(74) *Attorney, Agent, or Firm* — Gerald E. Hespos; Michael J. Porco; Matthew T. Hespos

(57) ABSTRACT

A treatment device (1) for use in a massage treatment, cosmetic treatment or wellness treatment, has a plate element (3) with a seat surface (5), a support area (7) and a support part (9). In a use position of the treatment device (1), a user sits on the seat surface (5) and a body part of a person being treated rests on the support part (9).

11 Claims, 4 Drawing Sheets

TREATMENT DEVICE

BACKGROUND

1. Field of the Invention

The invention relates to a treatment device which is suitable, for instance, for being used in a massage session and is appropriate in particular for mobile use.

2. Description of the Related Art

Nowadays, there are various treatment devices which are designed as a massage chair, for instance, with which the person who receives the massage is in a sitting position with a slight forward inclination. The buttocks of the person which receives the massage rest on a kind of seating plate while the knees of the bent legs rest on a knee support. The head is supported by a head rest. Clap Tzu, Movit, Massunda, Bodynova, Soleni and Massageliegenhaus are examples of companies selling such massage chairs.

Massage chairs of this kind have various disadvantages: The client is seated in the chair and the masseur must work in standing position. The transport with public transport means is difficult if not impossible due to the weight and size of such chairs. Face massages, cosmetic treatments and foot reflexology are not possible. Only neck and back can be treated, other body portions are not accessible. In addition, these chairs need a lot of space. Moreover, the patient has to be displaced, i.e. sick or handicapped persons or those with reduced mobility have to be seated for a start on such massage chair, which can be quite difficult. The cost factor has to be taken into consideration. Instructions in terms of cleaning and hygiene are amenable to the public health department. Typical data for such massage chairs are as follows: Weight starting from 8.5 kg, load capacity up to 110 kg, block dimensions 110 cm×51 cm×23 cm, for example.

There are also the well-known massage tables which are offered by following companies, for instance: Massunda, Living Earth Crafts, Earth Lite, Clap Tzu, Soleni, Massageliegenhaus. Here too, the therapist has to work in standing posture, the patient or client has to be displaced, and the space required is even larger. There are considerable problems during transport in public transport means and even for transporting them in a car, the massage tables are too big from case to case. These tables need much space for stowing even in the folded state. There is a considerable expenditure for cleaning, for extra sheets and cleaning agents.

A massage table of this kind is described in DE 20 2009 011 447 U1, for instance. This reference shows a massage table comprising a bi-functional head part, the peripheral area of the head part being able to be lowered independently of the inner area of the head part.

Further, there are head rests for being mounted to a table such as a kitchen table or desk or the like. Here, a head support is fastened to the edge of the table plate via a clamping mechanism. Head supports of this kind are sold by Massunda, Living Earth, Bodynova and Oakworks, for instance. The client is seated on a chair or stool with his viewing direction towards the table plate and may place the face on the head support. In doing so, there is the big disadvantage that the client is nearly always in an unfavorable posture as the overall system consisting of table plate, chair and head support can not be optimally adapted to the body size of the client. It is only possible to carry out a massage of the back, the masseur is in an inconvenient standing posture and the client usually has a bent spine in the region of the thoracic vertebrae with such solutions.

SUMMARY OF THE INVENTION

Therefore, it is the object of the invention to provide a treatment device with which the above-mentioned disadvantages can be eliminated. In a surprisingly simple manner, the treatment device solves the transport problem by being very small, on the one hand, and by it being combined with a bed or resting place which is present on site, on the other hand.

DETAILED DESCRIPTION OF THE PREFERRED EMBODIMENTS

Figure 1A:
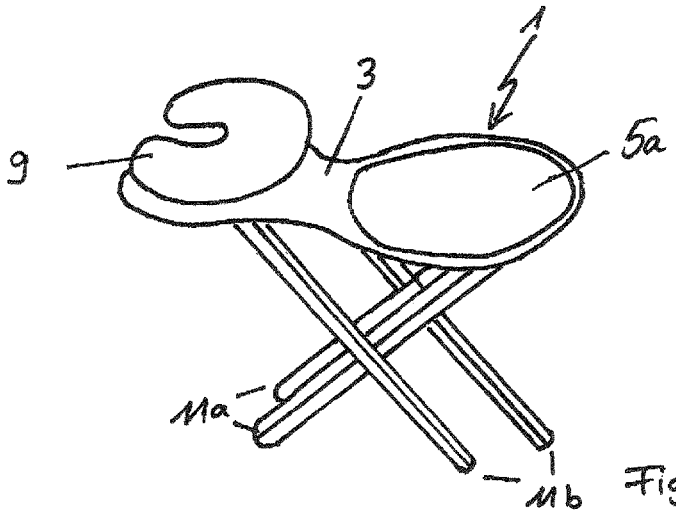
FIG. 1*a* shows a treatment device according to the invention in the deployed state and comprising a preferred, X-shaped leg construction.
Figure 1B:
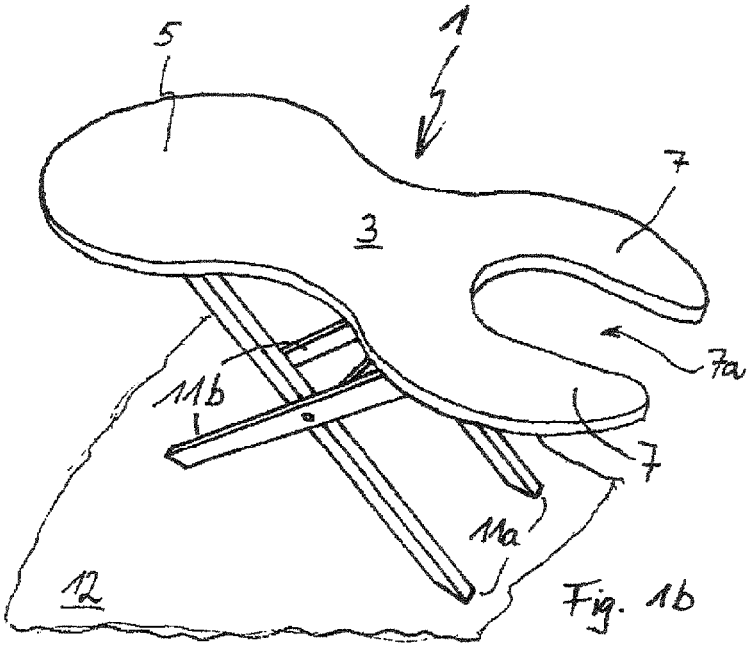
FIG. 1*b* schematically shows the treatment device according to the invention of FIG. 1*a*, with some parts being omitted.

FIG. 1*a* and FIG. 1*b* show the treatment device 1 according to the invention in the assembled state. The treatment device 1 essentially consists of a plate element 3 comprising a seat surface 5 and a support area 7. The plate element 3 is of elongated shape and has two concave portions at its longitudinal lateral edges. Provided on the support area 7 is a support part 9 which is preferably detachably fastened to the support area 7. A seat cushion 5*a* is provided on the seat surface 5. The legs of the treatment device 1 are realized as leg constructions 11*a*, 11*b*. The treatment device 1 stands on an installation area 12 in the position of use. The support area 7 has a U-shaped recess 7*a*.

The support part 9 is available in different versions: It may be a C-shaped conventional upholstery element as shown in FIG. 1*a*, as it is familiar from massage tables and known in the technical jargon under the German term "Massagehörnchen" (=C-shaped head or face support). This support part 9 may be connected with the support area 7 by means of a Velcro fastener, a plug-in connection, clamping connection, screw connection or adhesion connection, for example. The illustrated C-shaped support part 9 serves for supporting the face or the back of the head of a client in a massage session, for instance.

The treatment device according to the invention also allows to carry out a cosmetic treatment; to this end, a cosmetic support part (not shown) is provided. This cosmetic support part is substantially formed as a wedge-shaped upholstery element and offers a supporting face for the back of the head of the client, with the supporting face having an inclination between 20° and 45° to the horizontal. This results in a head position as it is usual for a cosmetic face treatment. In one embodiment, the support part may be shaped such that it is ergonomically adapted to the feet of a client. This support part has a foot-adapted support upholstery providing support for the feet and preventing them from sliding away. To this end, the support part may have a wavy configuration and/or be provided with cavities for the heel or instep zone of the feet. It is also possible to provide two differently shaped support parts for the feet, taking account of the anatomical circumstances, depending on whether the client has laid down his feet with the instep pointing upwards or downwards, one of these support parts especially being shaped for supporting the heel zones and the other one being anatomically formed for the instep zone. This allows to obtain a convenient supporting of the respective parts of the foot without any pressure points.

Thus, three support parts are primarily provided: A massage support part, a cosmetic support part and a foot support part. It is also envisaged to design the support part in the manner of a wash bowl so that a bedridden person can get a hair wash. This support part would have the shape of a tub partially adapted to the form of the head and equipped with a water discharge tube.

An adjustment system may be provided for the support part 9 situated between the support part 9 and the support area 7. This adjustment system serves for finely adjusting the height position of the support part relative to the plate element 3. Optionally, a tilting device is provided to be able to adjust the inclination of the support part 9 about its vertical axis. This is really advisable with treatments of the head: In many cases, it is only a positional change in the range of few millimeters which makes the difference between unsatisfactory and optimum head positions.

As can be seen in FIG. 1*a* and FIG. 1*b*, the leg constructions 11*a*, 11*b* of the treatment device 1 are arranged so as to be X-shaped, similar to leg constructions as known from ironing boards, for instance. In FIG. 1*a*, the leg construction 11*a* is articulated at the right side to the underside of the plate element 3. The leg constructions 11*a* and 11*b* are fastened to each other in their middle via a rod so as to be rotatable relative to each other and have their lower ends reinforced with a plate. With its upper ends, the leg construction 11*b* can be detachably arrested in different positions in the region of the underside of the support area 7 so as to be able to perform a height adjustment of the treatment device 1.

Figure 2:
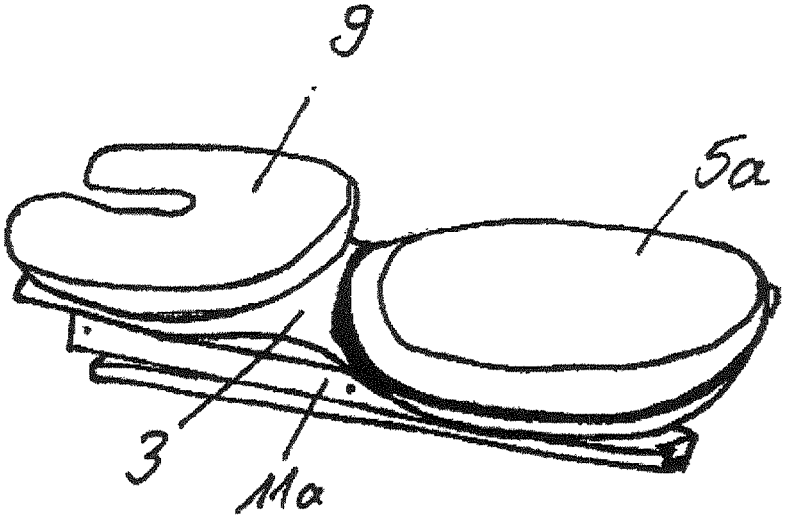
FIG. 2 shows the treatment device of the invention according to FIG. 1*a* in the folded state.

FIG. 2 shows the treatment device of the invention in the folded state. One can see the compact structure which can be readily loaded in a car. A sort of transport bag is also envisaged, by means of which the treatment device can be conveniently transported in the manner of a backpack (if it has to be carried from a car park to a client or patient, for instance). Advantageously, the leg constructions 11*a*, 11*b* can be locked in the state shown in FIG. 2, so that the risk of getting ones fingers caught during handling is eliminated.

Figure 3:
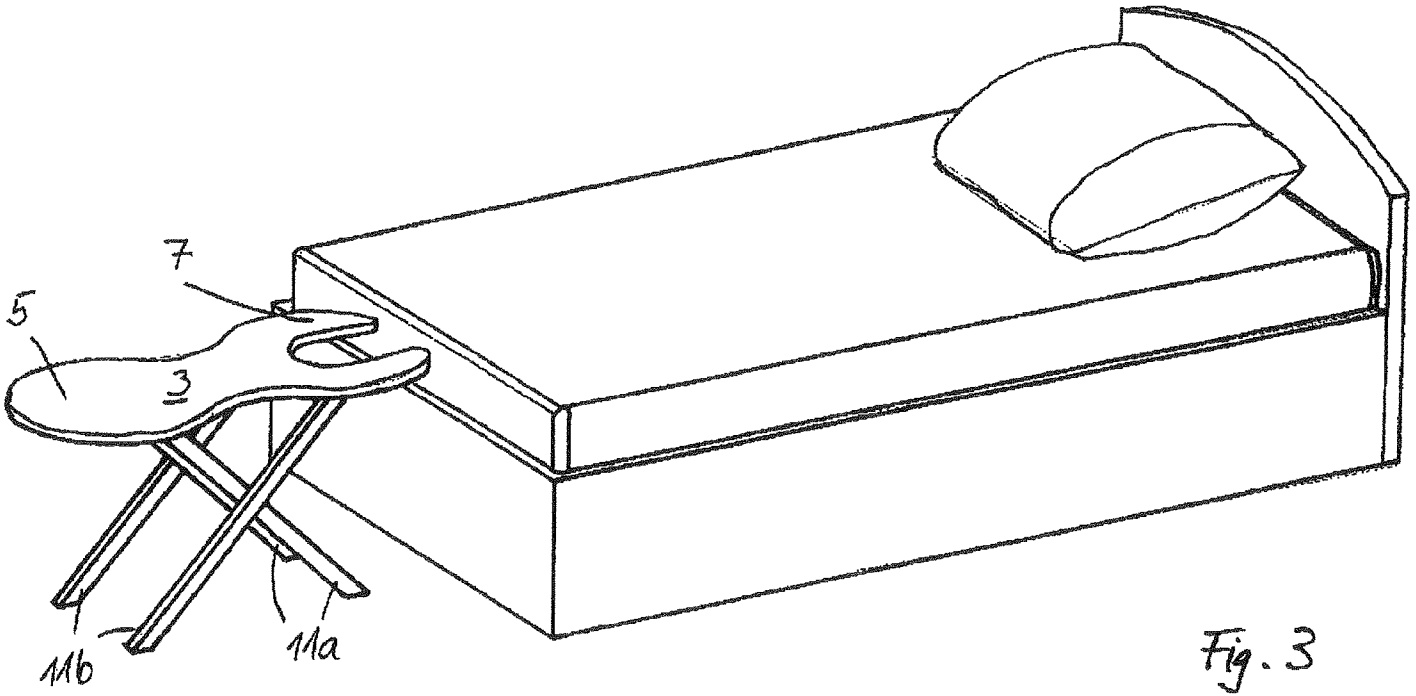
FIG. 3 schematically shows the treatment device of the invention, set up beside a bed.

The use of the treatment device 1 according to the invention is as follows, see FIG. 3: First, the leg constructions 11*a*, 11*b* are unfolded and adapted in height to a bed, for instance, on which the client/patient lies down or where the bedridden person already lies. The treatment device 1 is set up such that the support area 7 including the support part (not shown here) is immediately placed to the side of the bed, see FIG. 3.

Figure 4:
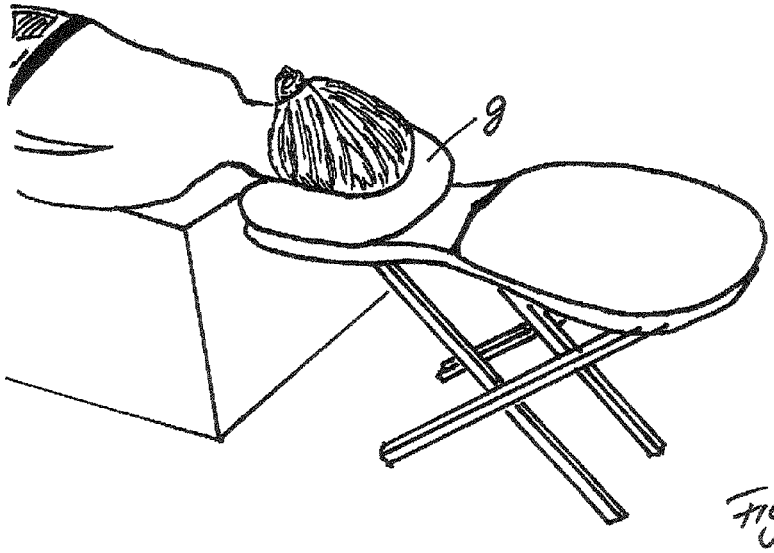
FIG. 4 shows the treatment device according to the invention, with the head of a patient resting thereon.
Figure 5:
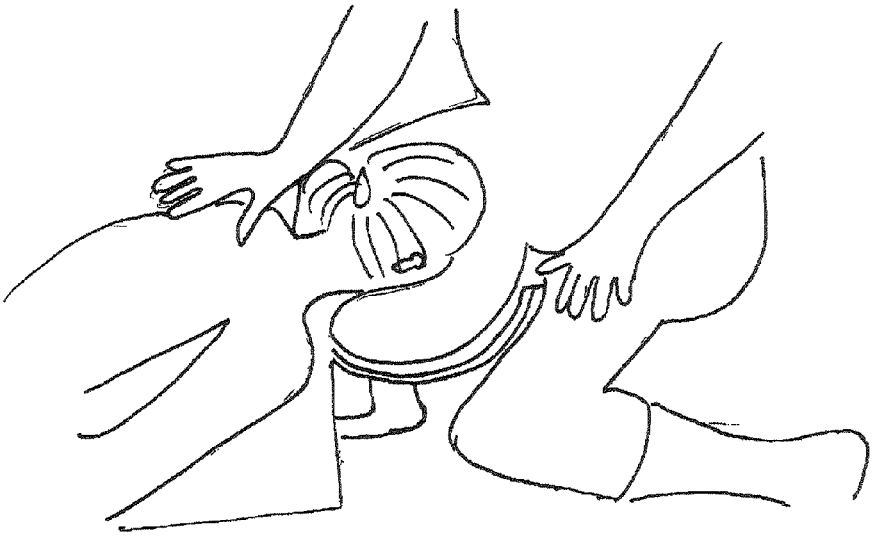
FIG. 5 shows the treatment device according to the invention in the state of use, with a therapist and the patient being seated thereon.

As shown in FIG. 4 and FIG. 5, the person to be treated lies down such that his/her face on the support part 9 points downwards. The treating person takes a seat, adjusts the height and inclination of the support part 9 by means of the adjustment device, and the treatment begins. This is a very favorable seating position for the treating person because it is ergonomic. The head or the feet of the client is/are situated between the thighs of the treating person and are in an optimum treatment position. Thus, the client is in lying position and the masseur in seating position, which is very comfortable and fatigue-proof for the latter. The big advantage is that the patient/client can be treated on his/her own bed or couch, even hospital bed etc. Thus, the treatment device is ideal for being used in hospitals, retirement homes, rehabilitation facilities and so on. Even a patient lying on a deck chair can be treated.

In summary, the treatment device offers the following advantages: It is very light-weight and still of stable construction. It has foldable leg constructions resulting in extremely narrow and small stowage dimensions. This folding function allows a particularly easy transport in small cars, or even with public transportation means. It is robust and very easy to handle. Due to its construction, working with this device is very health-sparing and joint-friendly for the treating person. It is distinguished by its functionality and comfortable upholstery. It can be manufactured at lower cost than the commercially available massage chairs and hence is affordable to each therapist. Especially for entrants with little money, the chair is a good alternative to go into business for oneself with mobile treatments.

An outstanding attribute of this invention is the mobile and flexible field of application e.g. in retirement homes, private households, office accommodations, airports and other places or buildings which do not offer a massage room. The aim of invention is to give the therapist the possibility to optimally treat his client on minimum space at home or in public health facilities or other buildings. No extra accessories are required. The chair represents a large simplification of the treatment scope. It is more efficient and flexible than any other treatment apparatus on the market. The treatment of a client requires very little space as the treatment device according to the invention can be adapted on the spot to present objects such as a bed or couch in the room. The clients/patients do not have to be transferred form one place to another.

All massage chairs or tables available up to now are so heavy and cumbersome that they only can be transported with a vehicle. The treatment device of the invention, however, does not necessarily require a vehicle for transporting it, because it can be stowed in a backpack which may be optionally be used as a tote. The storage is not only very space-saving, but due to the small dimensions easy to handle and transportable for everybody and every woman. The device can be folded with few manual operations and is stowed in the functional tote in a space-saving manner.

There is no need to rent therapy rooms. The client may stay at home in case he is weak. Any client may transform his rooms into treatment rooms, no matter how small they are. Sick, weak and old persons can be treated at home. The advantage of this chair is the possibility to create an optimum place of work for the therapist and at the same time an optimum place of treatment for the patient in smallest areas. Due to the small dimensions and the low weight, this chair can be transported easily without large expenditure (even without a vehicle of one's own). It is perfectly suitable for mobile use.

The treatment device 1 of the invention also allows longer treatment times in combination with a comfortable posture both for the treating person and the treated person. Apart from the purely technical design, the treatment device according to the invention has a modern and appealing shape, transforming the object to an eye catcher.

The plate element 3 comprises on both opposite sides a lateral indentation between the seat surface 5 and the support area 7, so that the plate element 3 is formed so as to be waisted between the seat cushion 5*a* and the support part 9. Thus, each of the indentations is situated between the two bulges of its longitudinal side of the plate element 3. If the treating person is seated on the seat cushion 5*a* and faces the support part 9, he has the possibility to accommodate his knees and/or thighs in the indentations, which is why the seating posture of the treating person is comfortable due to less straddled legs. Due to the fact that the indentations are arranged between the seat cushion 5*a* and the support part 9, the contact areas of the seat cushion 5*a* and of the support part 9 on the plate element 3 are not reduced by the indentations. This results in a stable and comfortable treatment device for the treating person.

Specifications (approximate data): The length of the plate element 3 including head part is approximately between 60 and 120 cm. The plate element 3 may be pear-shaped, oval, square, rectangular, or realized in all other geometrical shapes such as in the form of a horizontal figure eight. The width of the plate element 3 is 20 to 80 cm. The upholstery of the seat surface consists of a high-quality foam core for unique seating comfort, which is covered with a washable textile, and has a height of between 0 and 50 cm.

The employed cover textiles are free of pollutants and available in at least 10 different colors. The textiles are 100% vinyl soft artificial leather or a mixed fabric. The width of the plate element 3 ranges from 20 to 40 cm. The different support parts 9 are all provided with an upholstery. The treatment device is manually adjustable in height from 20 to 150 cm. It may comprise a connectable backrest for the therapist. The weight of the base model is approximately 4 kg to 8 kg. The weight of the support part plus the adjustment device ranges from approximately 1 to 3 kg. Loading capacity up to 150 kg. Only non-squeaking connections are manufactured. Further, attention is paid to an environment-friendly surface treatment of the wood. Warranty: Lifetime.

Fields of use: Medical massage chair, for wellness, cosmetic, reflexology, physiotherapy, orthopedics, rehabilitation, for the partner massage at home, mobile fields of application in office facilities, airports, old people's homes, hospitals.

The plate element 3 is a laminated board, wooden board, solid timber board in figure eight form, pear shape, rectangular form, square-shaped, oval etc. The lower ends of the leg constructions rest on a slip-free rubber element.

In the deployed state, the leg constructions 11*a*, 11*b* may also be parallel to each other, similar to the well-known beer tent tables. In this case, the leg constructions have to be adjustable in height so that the plate element 3 of the treatment device 1 according to the invention can reach a height of between 30 and 80 cm. The leg constructions 11*a*, 11*b* adjustable in length may be a combined construction of wood and metal, and it is possible that the wooden leg constructions may accommodate e.g. extractable rods or tubes made of metal. The leg constructions may be connected or braced with a wire rope construction. The leg constructions may be made from different materials, including steel, aluminum, metal, wood and hard plastics. The metal tubes may be provided with colorful coats of varnish.

The seat cushion preferably consists of a foam core giving a unique seating comfort; this foam core is covered with a washable textile and has a height of between 0 and 50 cm. The employed cover textiles are free of pollutants and available in at least 10 different colors. The textiles may be 100% vinyl soft artificial leather or a mixed fabric. The buyer can select between modern textile designs.

The support part 9 may be provided with an upholstery. A cover of the upholstery may consist to 100% of washable cotton wool, or of fleece, vinyl soft artificial leather etc. It is possible to use commercial single-use round tops as well as commercially available face towels. Preferably, the seat cushion as well as the surfaces of the support parts can be disinfected.

The transport bag or backpack for stowing and transporting the treatment device may optionally comprise a padding at the bottom and/or may be provided with borderings. This is recommendable for frequent and flexible transport and house calls. Manufactured from water-repellent and lightweight materials. Optionally, the transport bag is provided with rollers.

The scope of the invention would not be left if the plate element was not designed as a one-piece construction but composed of several parts. Here, it is possible to use a construction of two plate-shaped pieces, one for the seat surface and the other one for the support area, which are connected to each other, for instance, by means of an elongated central element such as a connection tube. This elongated connecting element may also include a feature so as to be able to adjust the length of the overall system in the manner of a sliding or telescope connection so that the distance between the seat surface and the support area can be adjusted.

The seat cushion 5*a* could comprise a raised portion at its rearward edge, or the seat cushion 5*a* has a distinct seating cavity in order to offer the treating person a better footing during work.

Further, the invention encompasses the variant according to which an absolutely normal chair is provided with an attachment part carrying a support part. In other words, if an attachment part is screwed or clamped to any, e.g. four-leg chair, with the support part for head or feet of a patient/client resting on said attachment part, this construction would fulfill the characteristics of the treatment device according to the invention.

The invention claimed is:

1. A treatment device (1) for being used in a massage, cosmetic or wellness treatment, comprising a plate element (3) which has a seat surface (5) and a support area (7), a seat cushion (5*a*) being disposed on the seat surface (5) and a support part (9) being disposed on the support area (7), a treating person being seated on the seat cushion (5*a*) in a position of use of the treatment device (1) and a body part of a treated person resting on the support part (9), two leg constructions (11*a*, 11*b*), one (11*a*) of the two leg constructions being articulated on the plate element (3) and the other (11*b*) being able to be detachably engaged in different positions on the plate element (3), wherein the leg constructions (11*a*, 11*b*) are parallel to the plate element (3) in a non-use position and are arranged in an X-shape with respect to the plate element (3) in the position of use.

2. The treatment device (1) of claim 1, wherein element (3) has a lateral indentation at both opposite sides between the seat surface (5) and the support area (7), so that the plate element (3) is narrowed between the seat cushion (5*a*) and the support part (9).

3. The treatment device (1) of claim 1, wherein the support part (9) is a support part selected from the group consisting of: a massage support part, a cosmetic support part and a foot support part.

4. The treatment device (1) of the claim 1, wherein the support area (7) comprises a U-shaped recess (7*a*).

5. The treatment device (1) of claim 1, wherein the support part (9) is detachably attached to the support area (7) of the plate element (3).

6. The treatment device (1) of claim 5, wherein the support part (9) is adjustable in height relative to the support area (7) of the plate element (3).

7. The treatment device (1) of claim 5, wherein the support part (9) is adjustable in its inclination relative to the support area (7) of the plate element (3).

8. The treatment device (1) of claim 1, further comprising a backrest in a region of the seat surface (5).

9. The treatment device (1) of claim 1, wherein the plate element (3) is configured so that the treated person only partly overlaps the plate element (3) in use of the treatment device (1).

10. The treatment device (1) of claim 1, wherein in use the treating person is seated on the treatment device (1) and at the same time a body region of the treated person is partially supported by the treatment device.

11. The treatment device (1) of claim 1, wherein the plate element (3) is substantially parallel to an installation area (12) in the position of use of the treatment device (1).

* * * * *